US005154418A

United States Patent [19]

Wortman

[11] Patent Number: 5,154,418

[45] Date of Patent: Oct. 13, 1992

[54] DEFLECTING CUSHION FOR BOWLING ALLEY

[76] Inventor: Alex Wortman, 1705 Wells, Ann Arbor, Mich. 48104

[21] Appl. No.: 676,330

[22] Filed: Mar. 28, 1991

[51] Int. Cl.[5] ..... A63D 5/00

[52] U.S. Cl. ..... 273/51; 273/54 R

[58] Field of Search ..... 273/9, 37, 51, 54 R

[56] References Cited

U.S. PATENT DOCUMENTS

| | | | |
|---|---|---|---|
| 4,025,974 | 5/1977 | Lea et al. | 5/367 |
| 4,330,122 | 5/1982 | Sheinberg et al. | 273/51 |
| 4,624,877 | 11/1986 | Lea et al. | 428/71 |
| 4,900,024 | 2/1990 | Chandler et al. | 273/54 R |

FOREIGN PATENT DOCUMENTS

| | | | |
|---|---|---|---|
| 3321755 | 12/1984 | Fed. Rep. of Germany | 273/51 |

OTHER PUBLICATIONS

AMF "New Products on Parade, Magic Triangle News" published by AMF Co. Bowling Products Group, Aug. 1965, p. 13.

*Primary Examiner*—William H. Grieb
*Assistant Examiner*—William M. Pierce
*Attorney, Agent, or Firm*—Emrich & Dithmar

[57] ABSTRACT

A deflecting cushion for positioning in the gutter of a bowling alley includes a self-inflating, open-cell compressible foam disposed within an elongated, flexible air-impervious tube closed at both ends. Disposed on one end of the tube is a first aperture with a cap for allowing air to enter the tube and the foam to self-inflate. The cushion may be collapsed for folding and storage by evacuating the tube. A second aperture having a valve such as a flap-type air valve may be provided to permit the tube to be pressurized slightly above atmospheric pressure after the tube is filled via the first aperture and the first aperture is sealed.

10 Claims, 2 Drawing Sheets

DEFLECTING CUSHION FOR BOWLING ALLEY

FIELD OF THE INVENTION

The present invention relates, in general, to the game of bowling; and more particularly it relates to a form of bowling, found useful for smaller children, beginners or those suffering from physical handicap, and sometimes referred to as "bumper" bowling. In this type of bowling, a conventional bowling alley is equipped with an elongated cushion or "bolster" extending the entire length and filling each gutter adjacent the central lane down which the bowling ball is directed.

The bolsters or cushions act to deflect the bowling ball, keeping it in play and preventing the participant from throwing a "gutter ball". Thus, the present invention is directed primarily to an improved deflecting cushion or bolster to be placed in the gutter of a conventional bowling alley which will deflect a bowling ball which otherwise would have gone into the gutter and out of play.

BACKGROUND OF THE INVENTION

Various devices have been conceived and tested for keeping bowling balls out of the gutter. Early attempts included long racks (approximately 12 ft.) which were placed in the gutters and were equipped with resilient rails for deflecting the ball. Another attempt involved rigid, half-round troughs in 12-foot sections which were inverted to cover the gutter like a dome. Even though some of these products have been field tested and offered for sale by large commercial corporations selling bowling lanes and other bowling equipment, these products for the most part have not been commercially successful. This is because these devices are either too expensive, impractical to install and maintain, or difficult to store when not in use. The length of a bowling alley is approximately 60 feet, so it can readily be appreciated that with two devices or systems required for each bowling alley, the cost per alley could be significant or the time, difficulty and expense of installation or set-up may be prohibitive, or the devices may be difficult to store, maintain or repair.

U.S. Pat. No. 4,330,122, in which I am a co-inventor with Sheinberg, represents the first practical, commercially successful solution to the problems encountered in other prior art devices. The device disclosed in our patent is an inflatable cushion or "bolster" which is filled with air only and may be pressurized slightly above atmospheric pressure to provide some rebound energy to a ball striking it. Our device has been widely accepted by the bowling industry to the extent that more than half of the bowling centers in the United States are now equipped with such inflatable cushions. These inflatable deflecting cushions solved the problems of prior attempts with a low-cost device which is easy to ship, install, set-up and store.

Very simply, the cushions are elongated cylindrical plastic tubes which are filled with air under pressure and then sealed. Each of the cushions has an air-fill aperture at one end so that inflation may be effected quickly by a motorized pump. These tubes may be filled in as little as three minutes with the proper equipment. A second aperture at the end of the deflection cushions described in the above-identified patent, is a one-way valve which is useful in "topping off" the tube after it was filled through the first aperture. That is, after the tube is inflated and the first aperture closed or sealed, the pump is then inserted in the second aperture which is provided with a simple flap-type air valve and a closure, permitting air to be forced into the tube to a pressure slightly higher than atmospheric, but permitting the pump to be removed from the aperture without losing this slight excess pressure. This results in a deflecting bumper having the desired characteristic of a slight resiliency to deflect the ball and keep it in play while not substantially reducing its speed. If an inflatable bumper is "flat" (that is, it does not have a slight pressure above atmospheric), it has a tendency to absorb the momentum of the ball and reduce the speed of a moving ball; and it also does not act properly in deflecting the ball.

The deflecting cushions described in our patent, however, suffer from one defect arising from the fact that they are used in a fairly demanding environment. For example, the cushions are typically installed by dragging or rolling them into position along the gutters, inflating the cushions, followed by sliding the cushions into proper position within the gutter. Many gutters have small edges of wood or nails projecting slightly outward, and these obstructions frequently snag the bumpers, causing slight pin holes. Over time, the bumper loses its slight excess pressure and its ability to rebound the ball diminishes. Of particular inconvenience is the fact that commercial inflatable bumpers are 56 feet long and it is difficult to locate a small leak, particularly since they are not designed to withstand a high internal pressure (like an automobile inner tube, for example). In addition, if such a small leak or pin point hole occurs during a game, the two bumpers may exhibit substantially different deflection characteristics, rendering the game less enjoyable and entertaining and perhaps even necessitating an interruption of the game.

Various materials for filling the deflection cushion disclosed in my patent have been suggested, including those mentioned in the patent itself such as durable foam, feathers or various other materials. However, merely filling the tube with a collapsible material does not necessarily provide a desirable solution to the problems discussed above. Although some of these materials provide at least a partial solution to the problem of leaks in inflatable, sealed tubes, they may create other problems such as the storage of bulky, cumbersome, only partly-deflatable cushions.

Following the inflated tubular cushion just described, at least one bowling center used conventional foamed plastic blocks having a rectangular cross-section of about three and one-half inches high by about eight and one-half inches wide. Although the foam was compressible in the sense of a sponge, the storage volume of these foam blades was substantially the same as the volume in use, thus, requiring a large area for storing the units when not in use.

SUMMARY OF THE INVENTION

The present invention includes an outer sheath or tube of plastic sheet material of the same general type and construction as that disclosed in my above-identified patent. As used herein, the word "tube" means that the periphery of the unit is closed, so that it might be sealed and pressurized. Preferably, the outer tube is cylindrical, but it may have a rectangular or other suitably cross-section as well.

The present invention provides for filling the tube with a self-inflating, open-cell collapsible, compactable foam. Preferably, the foam is such that its volume may be reduced by at least 60 to 65 percent simply by rolling the cushion up under hand pressure. With this material, the tube can be rolled almost flat—that is, almost all of the air can be forced out of the interior of the tube and the foam. Evacuation of the tube can be assisted by drawing a vacuum through a valve at the end of the cushion. This causes the foam to partially collapse in place in the gutter, and facilitates rolling the cushion up, thereby evacuating the small remaining amount of air in the cushion.

When the cushion is rolled up, the valve may be closed or a cap placed over the opening to prevent the interior foam from re-inflating. Thus, the collapsed cushion is sealed and maintains its low-volume storage condition. Once the valve is open or the cap removed, however, the foam is free to inflate, and will do so without any mechanical assistance. That is, by simply unrolling the cushion as it is taken from storage, and placing it in a generally "flat" condition along the length of the gutter, opening the valve allows air to rush into the cushion so as to inflate it. Eventually the entire cushion will assume its normal posture. A second one-way valve may be used as in the past to "top off" the cushion, if desired, after the first opening is, of course, sealed.

What is significant is that if a small pin hole or leak should occur in the cushion, the self-inflating foam retains sufficient deflection capability that the cushion does not act noticeably different from a normal, sealed cushion. In particular, a game need not be interrupted for maintenance if a leak should occur in a tube during a game.

With the improved construction, moreover, cushions may be more quickly made available to the bowling patron who wishes to use them. Set-up time as well as the auxiliary equipment needed to inflate prior cushions are eliminated. In addition, cushions of the present invention are more easily installed by less skilled workers than prior cushion installations. As with other industries, bowling centers are labor sensitive.

On the other hand, if an air pump is available, it may be used either to assist in inflating the cushions or in drawing a vacuum through the opening to collapse the cushion in place and permit it to be more easily and quickly rolled up for storage. This gives rise to a substantial saving of time and money to the bowling alley operator because normally both set-up and take-down occur during normal business hours. Finally, although the new cushion inflates itself, an air pump can be used to supply the slight pressure in excess of atmospheric pressure for providing an additional resilience in the deflection characteristic, if desired.

Preferably, the durometer rating of the foam should be sufficiently low to permit easy and quick roll-up of the cushion, while being sufficiently high for an adequate deflection characteristic when inflated.

Other features and advantages of the present invention will be apparent to persons skilled in the art from the following detailed description of a preferred embodiment accompanied by the attached drawing wherein identical reference numerals refer to like parts in the various views.

DETAILED DESCRIPTION OF A PREFERRED EMBODIMENT

Figure 1:
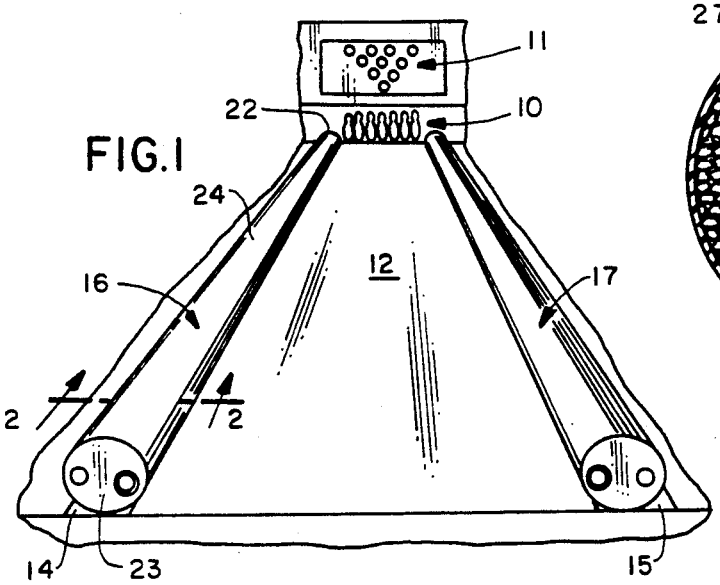
FIG. 1 is a perspective view of a bowling alley equipped with the improved deflecting cushions taken from the player's perspective.

Turning first to FIG. 1, there is shown a bowling alley, having at the far end a set of pins generally designated 10 above which there is a conventional display 11. The alley includes a central lane 12 down which a bowling ball is thrust, and first and second parallel side gutters 14, 15. First and second elongated deflecting cushions or bumpers 16, 17 are fitted in the gutters 14, 15, respectively. Each of the deflecting cushions 16, 17 is similar in construction so that only one need be described in detail for complete understanding of the invention.

It will be understood that each of the gutters 14, 15, and thus, each of the cushions 16, 17 extends almost the full length of the bowling alley. The cushions are approximately 56 feet in length whereas a bowling alley is 60 feet long. Although the deflecting cushions 16, 17 are each shown as a single cushion, they could, of course, be divided up into individual sections arranged end-to-end. In the latter case, it would be preferred that the segments be of approximately equal length to avoid confusion in storage and reassembly.

Figure 2:
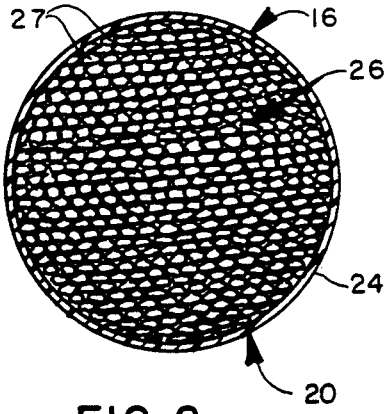
FIG. 2 is a vertical cross-sectional view of a deflecting cushion, in its expanded state, taken through sight line 2—2 of FIG. 1.
Figure 3:
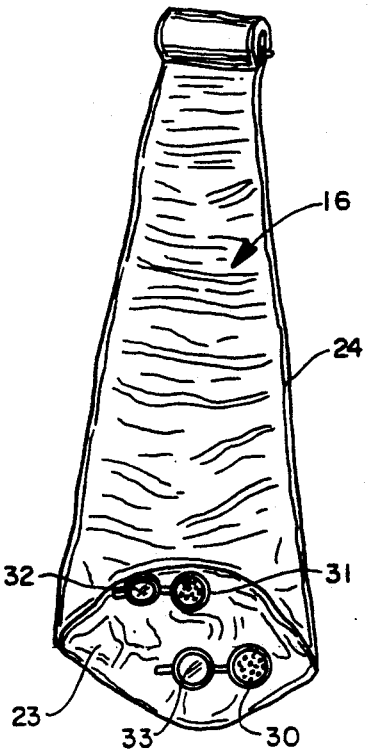
FIG. 3 is an upper perspective end view of an improved deflecting cushion which is deflated and partially rolled up.

Turning now to FIGS. 2 and 3, the deflecting cushion 16 includes an outer tubular air-impervious sleeve or cover 20 which may be made of any available air-impervious material, such as polyvinyl, polyethylene, or polyurethane film. I prefer polyurethane. The deflecting cushion 16 has two ends, designated respectively 22 and 23 in FIG. 1, and in the illustrated embodiment, the tube or cover 20 comprises a cylindrical, elongated central section 24 which has a circumference of approximately 25 inches, permitting it to conform to the radius of curvature of a normal bowling alley gutter. Alternatively, the tube may have any number of other cross-sectional shapes, such as rectangular (approximately 8½ inches wide by 3½ inches high), or it may have a rounded bottom to fit the gutter and upright walls for deflecting the ball. The primary characteristics of the shape of the tube are to provide deflection of the ball, retain its seating in the gutter and assume a greatly reduced storage volume when rolled up.

The cover 20 is filled with an open-cell foam plastic material which is readily compressible, yet which has a resilience and will re-inflate itself, if permitted. In the illustrated embodiment, the open-cell foam forming the core generally designated 26 is in the form of a plurality of discrete, individual pieces of foam, such as those designated 27. This is not important to the invention as those persons skilled in the art will readily recognize that a single body of plastic foam may be used, if desired, or a number of separate bodies, each having uniform cross section and extending for a portion of the length of the tube may be used, if desired.

Figure 6:
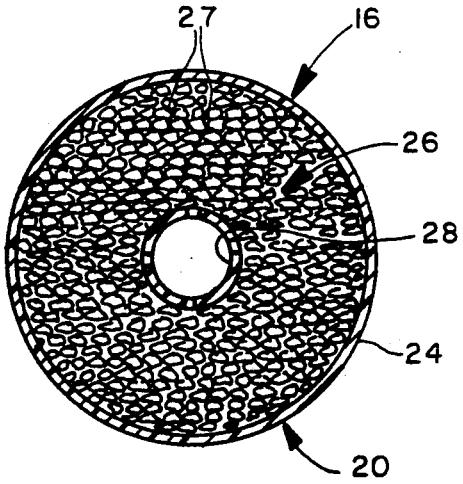
FIG. 6 is a view similar to FIG. 2 of a second embodiment of a deflecting cushion, shown in its expanded state.
Figure 7:
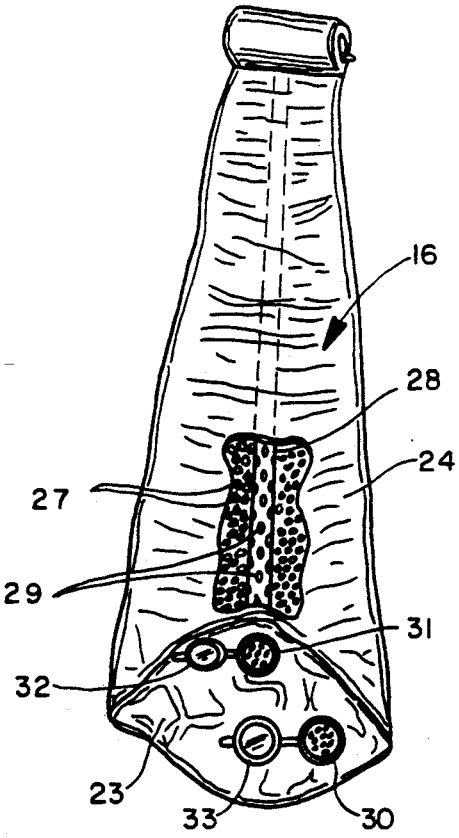
FIG. 7 is an upper perspective end view of the deflecting cushion of FIG. 6 shown deflated and partially rolled up, and partially cut away to illustrate the apertured core tube of the deflecting cushion.

One advantage of using individual pieces of foam of irregular shape (the size or range of sizes of the pieces is not critical) is that the spaces or interstices between adjacent pieces will be larger, permitting air to flow more rapidly through the entire length of the cushion during inflation. Alternatively with reference to FIGS. 6 and 7, in order to reduce set-up time, a collapsible, flexible core tube 28 having apertures 29 disposed along its length could be placed in the center of the core material 26, thereby permitting air to flow or be forced axially through the core tube 28, when exposed, while simultaneously permitting air to flow radially outwardly of the apertured core tube to facilitate and expedite inflation of the individual pieces of foam.

One of the end sections, such as that designated 23 in FIG. 1, preferably has two sealable apertures designated 30 and 31, respectively. One aperture is preferably provided with a uni-directional air valve such as a flap (not shown for simplicity) which permits air to flow into the tube but not out of the tube. Such a valve could be installed in aperture 31 for use after the tube is inflated and the other aperture 30 is sealed by means of a cap 33. Aperture 31 could then be used to "top off" the tube with additional air, forced under pressure, to generate an internal pressure slightly higher than atmospheric, depending upon the desired deflection characteristics of the cushion. The opening 31 may then be sealed off by a cap 32. The other opening 30 need not have a valve, but it is also provided with a cap or sealing member 33. It is important that the cushion be sealed in use to provide desirable deflection characteristics. It is desirable that the tube also be sealed after it is deflated for storage in order to maintain its reduced volume and avoid inflating, as the foam will tend to do.

Aperture 30 is normally open during assembly and disassembly. During assembly, aperture 30 permits air to flow into the cushion and the individual foam pieces 27 to inflate. Aperture 30 may also be used to force air into the cushion if it is desired to use a powered air pump, and the same aperture may be used to deflate the cushion for storage, either by connecting the air pump in reverse flow and thereby evacuating the cushion, or simply to force air out through the aperture 30 by rolling up the cushion from the opposite end as illustrated in FIG. 3.

Figure 4:
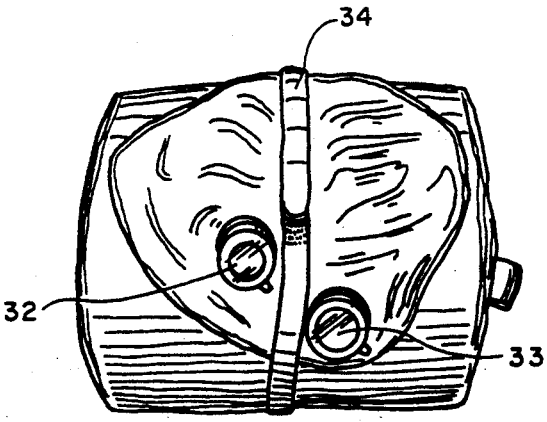
FIG. 4 is a view of the cushion in FIG. 3 which is fully rolled up and strapped for storage.
Figure 5:
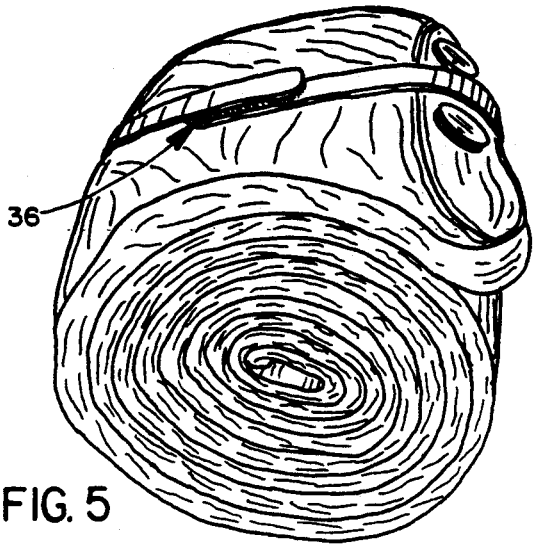
FIG. 5 is an upper side perspective view of the rolled up cushion seen in FIG. 4.

Turning now to FIGS. 4 and 5, after the cushion is fully rolled up, an adjustable length strap or other tie, such as that designated 34 in the drawing, may be used to secure it in the rolled-up configuration for storage. The strap 30, if desired, may be adjustable in length by using a conventional hook and fabric fastener such as that commercially available under the trademark "Velcro", as designated generally by reference numeral 36 in FIG. 5.

Once air is evacuated from the cushion, both closures 32, 33 are used to seal off their associated apertures so there is no tendency for the cushion to re-inflate.

Although there are many foams that may be useful and have the required characteristics for practicing the invention, one such foam found to be suitable is a polyether having a density of one to six pounds per cubic foot, an open-cell structure, a tensile strength of 7–15 pounds per square inch, an elongation of 250% and is available through Foamade Industries of Auburn Hills, Mich. Another suitable foam, available through Plastomer Corporation of Livona, Mich. under the designation 46-SS, has a density of 1.3–1.8 pound per cubic foot, a tensile strength of ten pounds per square inch per minute, an elongation percentage of 160%, a tear strength of 1.7 pounds per square inch per minute, and an air flow range of 5–40 CFM. This foam has a 50% compress set of 12% maximum, and a 25% deflection minimum of 0.12 pounds per square inch. Persons skilled in the art will be able to substitute a number of equivalent plastic foams useful for practicing the invention, but it is considered to be essential that any such foam be resilient, that it be open-cell, that it have a low density and be easily compressed, and that it be self-inflating.

Preferably the foam should have a greatly reduced volume when compressed under normal hand pressure. For example, the entire cushion, when deflated and rolled up should be reduced in volume by at least 60–65 percent and as much as 75%, so that the storage volume is about 25–40% of the use volume of the cushion.

Having thus disclosed one embodiment of the invention, persons skilled in the art will be able to modify certain of the structure which has been described and to substitute equivalent elements for those disclosed while continuing to practice the principle of the invention; and it is, therefore, intended that all such modifications and substitutions be covered as they are embraced within the spirit and scope of the appended claims.

I claim:

1. An improved deflecting cushion for use in a bowling alley comprising: an elongated tubular cover of flexible, air-impervious material having first and second closed ends and an elongated intermediate section; low-density, self-inflating, easily compressible, open-cell plastic foam in said cover and substantially filling the same from end to end; and at least one sealable opening in said cover, whereby said cushion may be compressed by rolling the same under hand pressure with said aperture open for exhausting air from within said cover and from said foam through said aperture, and said cushion will be self-inflating if unrolled and said opening is left unsealed.

2. The apparatus of claim 1 characterized in that said foam comprises a plurality of individual pieces of plastic foam whereby the spaces between said pieces will permit air to flow more easily through the entire length of said cushion.

3. The apparatus of claim 1 including a collapsible, flexible core tube having apertures disposed along its length and defining an open air passage extending substantially the length of the cushion for permitting air to flow through the length of the cushion in the expanded condition and then radially outward to fill said foam.

4. The apparatus of claim 1 wherein said cover is formed of an abrasion resistant, air-impervious, flexible plastic material.

5. The apparatus of claim 4 wherein the plastic material of said cover is polyurethane.

6. The apparatus of claim 1 further including a removable cap for sealing said aperture.

7. The apparatus of claim 1 further comprising a second aperture in said end of said cover, said second aperture being provided with a uni-directional air valve permitting air to flow into the cover but not out of the cover; and means for sealing said second aperture, whereby a powered air blower may be used, if desired, to fill the cushion and to generate a pressure within said cushion slightly above atmospheric pressure via said second aperture.

8. The apparatus of claim 1 further including strap means for securing the cushion when rolled up.

9. The apparatus of claim 1 characterized in that said foam is compressible such that said cushion has a storage volume when rolled up of less than about 40% of its inflated use volume.

10. The apparatus of claim 9 characterized in that said cushion has a storage volume of about 25% of its use volume.

* * * * *